US011309120B2

(12) United States Patent
Yen

(10) Patent No.: US 11,309,120 B2
(45) Date of Patent: Apr. 19, 2022

(54) TRANSFORMER STRUCTURE

(71) Applicant: Realtek Semiconductor Corporation, Hsinchu (TW)

(72) Inventor: Hsiao-Tsung Yen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 588 days.

(21) Appl. No.: 16/164,889

(22) Filed: Oct. 19, 2018

(65) Prior Publication Data

US 2019/0252110 A1 Aug. 15, 2019

(30) Foreign Application Priority Data

Feb. 9, 2018 (TW) ..... 107104797

(51) Int. Cl.

| | |
|---|---|
| ***H01F 27/29*** | (2006.01) |
| ***H01F 5/00*** | (2006.01) |
| ***H01F 27/28*** | (2006.01) |
| *H01F 5/04* | (2006.01) |

(52) U.S. Cl.

CPC ..... *H01F 27/2804* (2013.01); *H01F 27/29* (2013.01); *H01F 5/003* (2013.01); *H01F 5/04* (2013.01); *H01F 2005/043* (2013.01); *H01F 2027/2809* (2013.01); *H01F 2027/2819* (2013.01)

(58) Field of Classification Search

CPC ..... H01F 27/2804; H01F 27/29; H01F 2027/2819; H01F 5/04; H01F 2005/043; H01F 5/003; H01F 2027/2809

See application file for complete search history.

(56) References Cited

U.S. PATENT DOCUMENTS

| | | | | |
|---|---|---|---|---|
| 5,477,204 | A * | 12/1995 | Li | H01F 17/0006 336/200 |
| 6,653,910 | B2 * | 11/2003 | Escalera | H01P 5/10 333/25 |
| 8,008,987 | B2 * | 8/2011 | Chen | H03H 7/422 333/25 |
| 2015/0364243 | A1 | 12/2015 | Yen et al. | |
| 2017/0098500 | A1 | 4/2017 | Yen et al. | |

FOREIGN PATENT DOCUMENTS

| | | | |
|---|---|---|---|
| CN | 1378219 | A | 11/2002 |
| CN | 103337682 | A | 10/2013 |
| CN | 106571211 | A | 4/2017 |
| TW | 201714278 | A | 4/2017 |
| TW | 107107742 | | 3/2018 |
| TW | I634570 | B | 9/2018 |

OTHER PUBLICATIONS

U.S. Appl. No. 16/129,861, filed Sep. 13, 2018.

* cited by examiner

*Primary Examiner* — Tuyen T Nguyen
(74) *Attorney, Agent, or Firm* — Locke Lord LLP; Tim Tingkang Xia, Esq.

(57) ABSTRACT

Present disclosure relates to a transformer structure. The transformer structure includes a first inductor and a second inductor. The first inductor has first turns and second turns. The second inductor has third turns and fourth turns. The first turns of the first inductor and the third turns of the second inductor are mutually disposed in a first area of a first metal layer. The second turns of the first inductor and the fourth turns of the second inductor are mutually disposed in a second area of the first metal layer. The first area is adjacent to the second area.

20 Claims, 4 Drawing Sheets

TRANSFORMER STRUCTURE

CROSS-REFERENCE TO RELATED APPLICATION

This application claims priority to Taiwan Application Serial Number 107104797, filed on Feb. 9, 2018, which is herein incorporated by reference.

BACKGROUND

Field of Invention

The present disclosure relates to an inductor structure. More particularly, the present disclosure relates to a transformer structure.

Description of Related Art

Nowadays, inductor apparatuses are essential in integrated circuits, as well as the transformer structure formed by inductors. However, achieving a satisfactory higher inductance usually brings about the decrease of coupling coefficient and quality factor. Therefore, an improvement to these transformer structures is required.

SUMMARY

The disclosure provides a transformer structure having good quality factor (Q value).

The disclosure relates to a transformer structure. The transformer structure comprises a first inductor and a second inductor. The first inductor has first turns and second turns. The second inductor has third turns and fourth turns. The first turns of the first inductor and the third turns of the second inductor are mutually disposed in a first area of a first metal layer. The second turns of the first inductor and the fourth turns of the second inductor are mutually disposed in a second area of the first metal layer. The first area is adjacent to the second area.

As mentioned, the transformer structure includes two symmetric inductors, the first inductor and the second inductor. The first inductor and the second inductor form the twin transformer. The turns of the first inductor and the second inductor is disposed to sense currents passed from different direction, and the magnetic fields generated by the inductors are offset with each other. Thus, the transformer structure introduces fewer impacts to other parts in the integrated circuit board, and it is thus difficult to be coupled by the AC signals carried on other parts or metallic segments. As a result, the quality factor obtained from such transformer structure is good.

It is to be understood that both the foregoing general description and the following detailed description are by examples, and are intended to provide further explanation of the disclosure as claimed.

BRIEF DESCRIPTION OF THE DRAWINGS

Present disclosure can be more fully understood by reading the following detailed description of the embodiments, with reference made to the accompanying drawings as follows.

DETAILED DESCRIPTION

Figure 1:
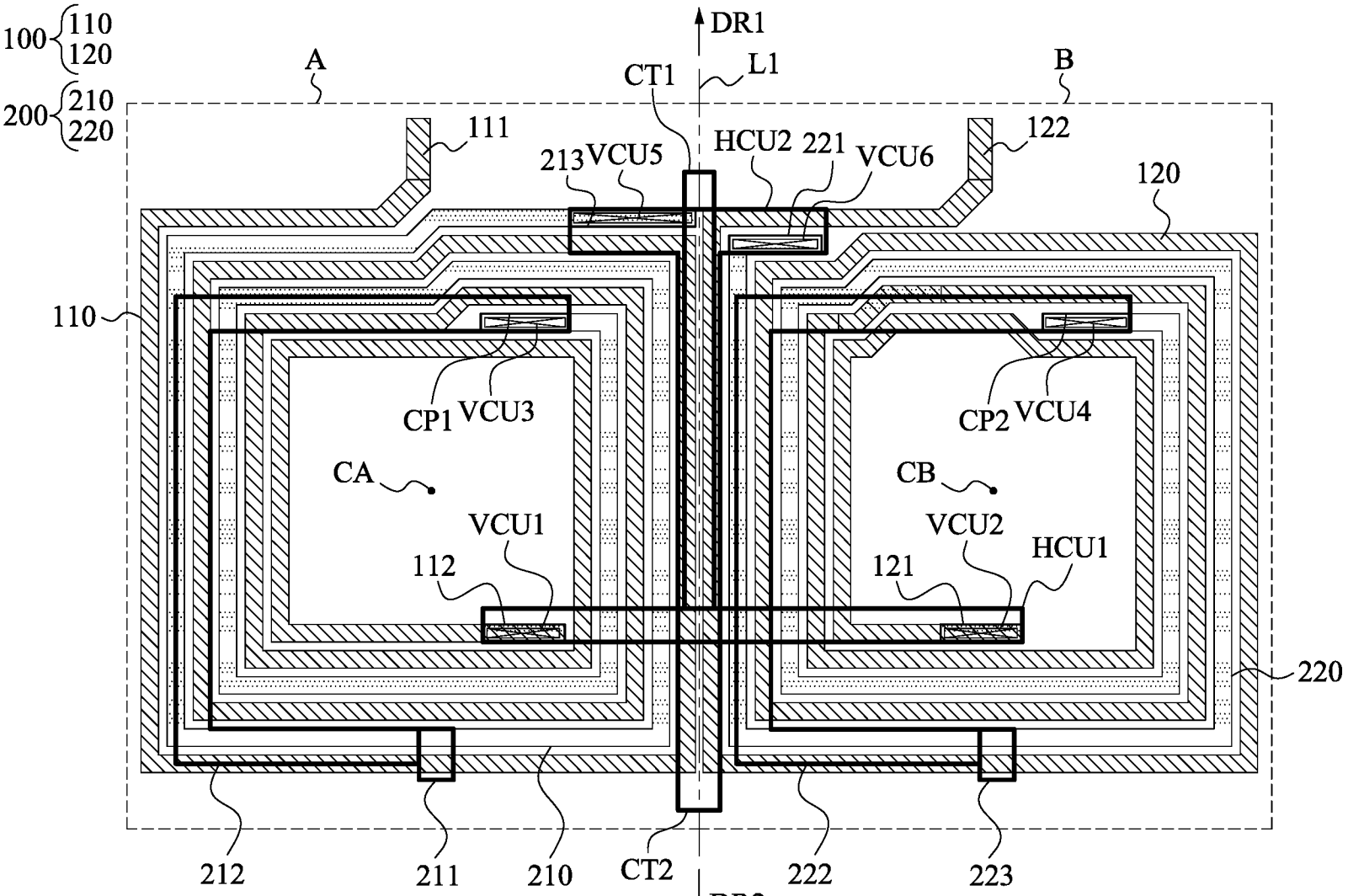
FIG. 1 is a schematic diagram of a transformer structure according to an embodiment of present disclosure.

Reference will now be made in detail to the present embodiments of the disclosure, examples of which are illustrated in the accompanying drawings. Wherever possible, the same reference numbers are used in the drawings and the description to refer to the same or like parts.

The terms used in this specification generally have their ordinary meanings in the art and in the specific context where each term is used. The use of examples in this specification, including examples of any terms discussed herein, is illustrative only, and in no way limits the scope and meaning of the disclosure or of any exemplified term. Likewise, the present disclosure is not limited to various embodiments given in this specification.

As used herein, the terms "comprising," "including," "having," and the like are to be understood to be open-ended, i.e., to mean including but not limited to.

Reference throughout the specification to "one embodiment" or "an embodiment" means that a particular feature, structure, implementation, or characteristic described in connection with the embodiment is included in at least one embodiment of the present disclosure. Thus, uses of the phrases "in one embodiment" or "in an embodiment" in various places throughout the specification are not necessarily all referring to the same embodiment. Furthermore, the particular features, structures, implementation, or characteristics may be combined in any suitable manner in one or more embodiments.

In the following description and claims, the terms "coupled" and "connected", along with their derivatives, may be used. In particular embodiments, "connected" and "coupled" may be used to indicate that two or more elements are in direct physical or electrical contact with each other, or may also mean that two or more elements may be in indirect contact with each other. "Coupled" and "connected" may still be used to indicate that two or more elements cooperate or interact with each other.

FIG. 1 is a schematic diagram showing an above view of a transformer structure according to an embodiment of present disclosure. In the embodiment, twin planar inductors, which are a first inductor 100 and a second inductor 200, form the transformer structure. The first inductor 100 includes first turns 110 and second turns 120. The second inductor 200 includes third turns 210 and fourth turns 220. The first inductor 100 and the second inductor 200 are substantially disposed on a first metal layer of an integrated circuit board (not shown in the figure). As shown in FIG. 1, a first imaginary line L1 is illustrated. The first imaginary line L1 passes through the center of the first metal layer of the integrated circuit board, demarcating the the first metal layer of the integrated circuit board into a first area A and a second area B. The first area A has a first central point CA and the second area B has a second central point CB. The first turns 110 of the first inductor 100 and the third turns 210 of the second inductor 200 are concentrically disposed in the first area A, based on the first central point CA. The second turns 120 of the first inductor 100 and the fourth turns 220 of the second inductor 200 are concentrically disposed in the second area B, based on the second central point CB.

In the embodiment, the first area A has four sides, which are a first side, a second side, a third side and a fourth side. As illustrated in FIG. 1, the first side of the first area A is the upside of the first area A and the second side of the first area A is the left side of the first area A. Moreover, the third side of the first area A is the downside of the first area A, and the fourth side of the first area A is the right side of the first area A. Similar to the first area A, the second area B has a first side, a second side, a third side and a fourth side as well. In the same manner, the first side of the second area B is the upside of the second area B and the second side of the second area B is the left side of the second area B. Moreover, the third side of the second area B is the downside of the second area B, and the fourth side of the second area B is the right side of the second area B. In this case, the fourth side of the first area A is adjacent to the second side of the second area B.

As shown in FIG. 1, the first turns 110 of the first inductor 100, disposed in the first area A, includes a first port 111 and a terminal end 112. The first port 111 is disposed at the first side of the first area A, outside a region covered by the first turns 110 and the third turns 210. The terminal end 112 is disposed between the third side and the fourth side of the first area A, substantially inside the region covered by the first turns 110 and the third turns 210. As shown in the figure, the first turns 110 are disposed on the first area A in an outer-inner manner. Specifically, the first turns 110 wind from the first side to the second side, then from the third side to the fourth side of the first area A in a counterclockwise manner. It is noted, the first turns 110 of the first inductor 100 are, substantially, formed by three and half turns of metallic segments in the first area A.

As shown in FIG. 1, the first turns 110 of the first inductor 100, disposed in the second area B, includes an initial end 121 and a second port 122. The initial end 121 is disposed at the third side of the second area B, substantially inside a region covered by the second turns 120 and the fourth turns 220. The second port 122 is disposed at the first side of the second area B, outside the region covered by the second turns 120 and the fourth turns 220. As shown in the figure, the second turns 120 are disposed on the second area B, from the initial end 121 to the second port 122, in an inner-outer manner. Specifically, the second turns 120 wind from the third side to the second side, then from the first side to the fourth side of the second area B in a clockwise manner. It is noted, the second turns 120 of the first inductor 100 are, substantially, formed by three and half turns of metallic segments in the second area B.

As shown in FIG. 1, the first inductor 100 further includes a first horizontal connecting segment HCU1. The first horizontal connecting segment HCU1 is disposed on a second metal layer different from the first metal layer. On the integrated circuit board, the second metal layer is an upper layer or lower layer with respect to the first metal layer. It is noted, as shown in the above view, if each of the first area A and the second area B has a projection region on the second metal layer, the first horizontal connecting segment HCU1 extends from one of the projection regions to another, relatively. More specific, although the first horizontal connecting segment HCU1 is disposed on the second metal layer, the first horizontal connecting segment HCU1 is used to bridge the metallic segments on the first metal layer. One end of the first horizontal connecting segment HCU1 is connected to the terminal end 112 of the first turns 110 via a first vertical connecting segment VCU1, and another end of the first horizontal connecting segment HCU1 is connected to the initial end 121 of the second turns 120 via a second vertical connecting segment VCU2. Through the bridge of the first horizontal connecting segment HCU1, the first port 111 of the first inductor 100 is electrically connected to the second port 122 of the first inductor 100. In the embodiment, the first port 111 and the second port 122 are two differential ports disposed in parallel. Furthermore, the first horizontal connecting segment HCU1 is connected to a first center tap CT1, which is parallel to the first imaginary line L1, extended toward a first direction DR1. As shown in the figure, the first port 111, the second port 122 and the first center tap CT1 of the first inductor 100 are all extended in the first direction DR1.

As shown in FIG. 1, the third turns 210 of the second inductor 200 includes a third port 211, a first extension segment 212, a third vertical connecting segment VCU3, a first connecting end CP1 and a terminal end 213. It is noted, the third port 211 is disposed on a third metal layer. On the integrated circuit board, the third metal layer is an upper layer or lower layer with respect to the first metal layer and the second metal layer. As shown in the above view, if the first area A has a projection region on the third metal layer, the third port 211 is disposed at the third side within the projection region of the first area A, relatively. The third port 211 is connected to one end of the first extension segment 212, in which the first extension segment 212 is disposed on the third metal layer. In the above view of the integrated circuit board, the first extension segment 212 is formed in C-shape. Another end of the first extension segment 212 is connected to the first connecting end CP1, via the third vertical connecting segment VCU3. The first connecting end CP1 is substantially disposed between the first side and the fourth side of the first area A, on the first metal layer. The third turns 210, on the first metal layer, are arranged from the first connecting end CP1 to the terminal end 213 in an inner-outer manner. The third turns 210 winds from the fourth side to the third side of the first area A, then from the second side to the first side in a clockwise manner. The terminal end 213 is disposed between the first side and the fourth side of the first area A, substantially outside a region covered by the third turns 210. It should be noted that the third turns 210 of the second inductor 200 are, substantially, formed by two turns of metallic segments in the first area A. If the third port 211 and the first extension segment 212 disposed on the third layer are included, the third turns 210 of the second inductor 200 as a whole are formed by two and half turns of metallic segments.

As shown in FIG. 1, the fourth turns 220 of the second inductor 200 includes an initial end 221, a second connecting end CP2, a fourth vertical connecting segment VCU4, a second extension segment 222 and a fourth port 223. The initial end 221 is disposed between the first side and the second side of the second area B. The second connecting end CP2 is substantially disposed between the first side and the fourth side of the second area B, on the first metal layer. The fourth turns 220, on the first metal layer, are arranged from the initial end 221 to the second connecting end CP2 in an inner-outer manner. The fourth turns 220 are wound from the second side to the third side of the first area A, then from the fourth side to the first side in a counterclockwise manner. The second connecting end CP2 is connected to one end of the second extension segment 222, via the fourth vertical connecting segment VCU4. The second extension segment 222 is disposed on the third metal layer. As shown in the above view, if the second area B has a projection region on the third metal layer, the second extension segment 222 is disposed within the projection region of the second area B relatively. In the above view of the integrated circuit board, the second extension segment 222 is formed in C-shape. Another end of the second extension segment 222 is connected to the fourth port 223. As shown in the figure, the fourth port 223 is disposed at the third side within the projection region of the second area B, relatively. It is noted, the fourth turns 220 of the second inductor 200 are, substantially, formed by two turns of metallic segments in the second area B. If the fourth port 223 and the second extension segment 222 disposed on the third layer are included, the fourth turns 220 of the second inductor 200 as a whole are formed by two and half turns of metallic segments.

As shown in FIG. 1, the second inductor 200 further includes a second horizontal connecting segment HCU2. The second horizontal connecting segment HCU2 is disposed on the third metal layer. It should be noted, as shown in the above view, if each of the first area A and the second area B has the projection region on the second metal layer, the second horizontal connecting segment HCU2 extends from one of the projection regions to another, relatively. More specific, although the second horizontal connecting segment HCU2 is disposed on the third metal layer, the second horizontal connecting segment HCU2 is used to bridge the metallic segments on the first metal layer. One end of the second horizontal connecting segment HCU2 is connected to the terminal end 213 of the third turns 210 via a fifth vertical connecting segment VCU5, and another end of the second horizontal connecting segment HCU2 is connected to the initial end 221 of the fourth turns 220 via a sixth vertical connecting segment VCU6. Through the bridge of the second horizontal connecting segment HCU2, the third port 211 of the second inductor 200 is electrically connected to the fourth port 223 of the second inductor 200. In the embodiment, the third port 211 and the fourth port 223 are two differential ports disposed in parallel. Furthermore, the second horizontal connecting segment HCU2 is connected to a second center tap CT2, which is parallel to the first imaginary line L1, extended toward a second direction DR2. As shown in the figure, the second direction DR2 is opposite to the first direction DR1. In the embodiment, the third port 211, the fourth port 223 and the second center tap CT2 of the second inductor 200 are all extended in the second direction DR2.

In general, as shown in the embodiment of FIG. 1, the first inductor 100 is formed by the first turns 110 and the second turns 120. As shown in the above view, the first inductor 100 is substantially an eight-shaped planar inductor. In the embodiment of FIG. 1, the second inductor 200 is formed by the third turns 210 and the fourth turns 220. As shown in the above view, the second inductor 200 is an eight-shaped planar inductor as well. It should be noted that in each of the first area A and the second area B, the turns of the first inductor 100 and the second inductor 200 are mutually disposed.

Figure 2:
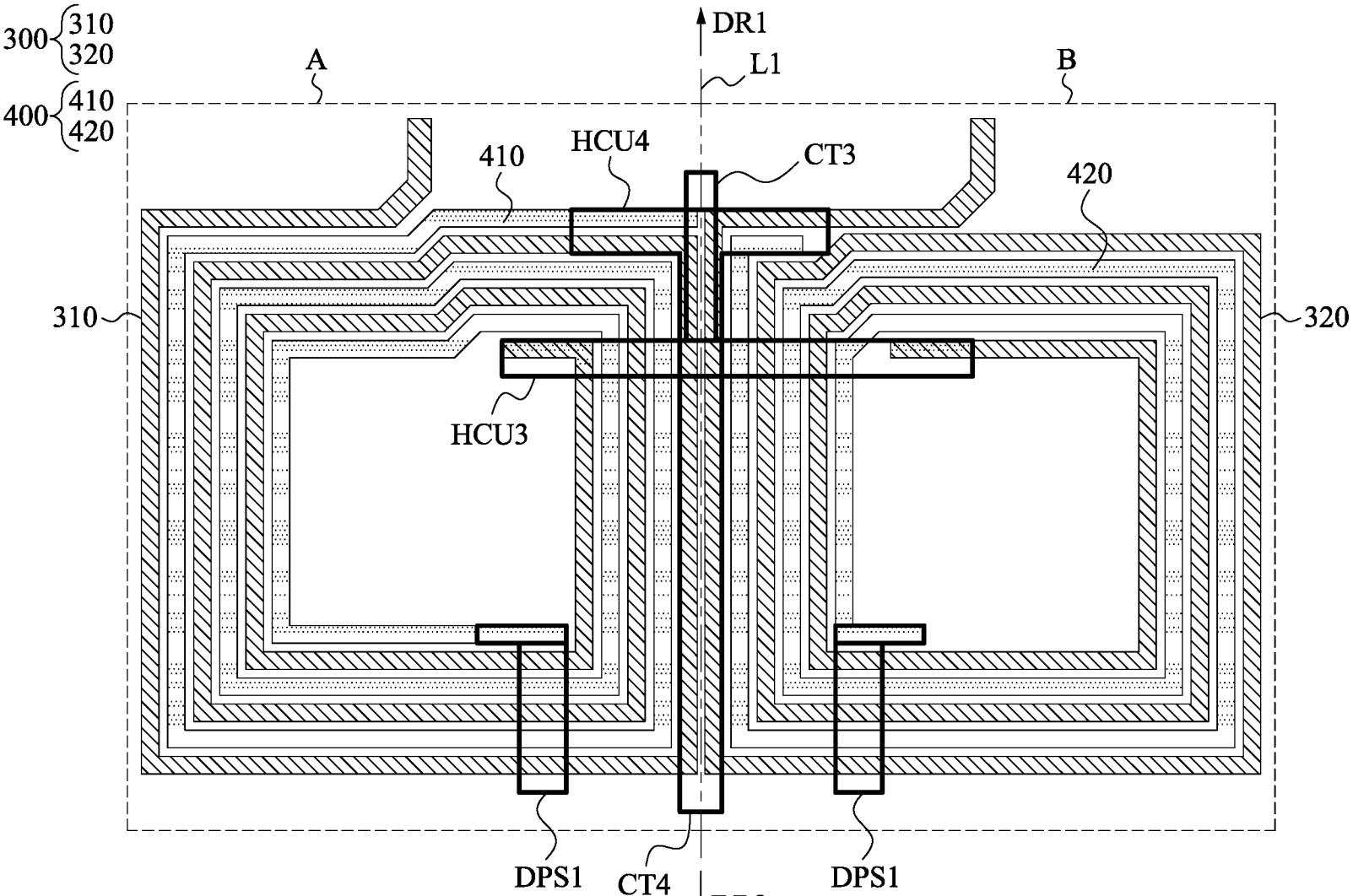
FIG. 2 is a schematic diagram of a transformer structure according to an embodiment of present disclosure.

FIG. 2 is a schematic diagram showing an above view of a transformer structure according to an embodiment of present disclosure. In the embodiment, twin planar inductors, which are a third inductor 300 and a fourth inductor 400, form the transformer structure. The third inductor 300 includes fifth turns 310 and sixth turns 320. The fourth inductor 400 includes seventh turns 410 and eighth turns 420. In general, the arrangements of the third inductor 300 and the fourth inductor 400 are similar to the first inductor 100 and the second inductor 200 as shown in FIG. 1. The third inductor 300 and the fourth inductor 400 are substantially disposed on the first metal layer of an integrated circuit board. However, in comparison with the embodiment of FIG. 1, the fifth turns 310 and the sixth turns 320 in the embodiment have different numbers of turns in the first area A and the second area B, respectively. The seventh turns 410 and the eighth turns 420 in the embodiment have different numbers of turns in the first area A and the second area B, respectively. Thus, based on the difference of the turn numbers of the third inductor 300, a third horizontal connecting segment HCU3 is disposed to connect the fifth turns 310 with the sixth turns 320. The third horizontal connecting segment HCU3 is connected to a third center tap CT3 extending toward the first direction DR1. In the embodiment, a pair of differential ports DPS1 is disposed on the third metal layer, connected to the seventh turns 410 and the eighth turns 420 of the fourth inductor 400, respectively. The pair of differential ports DPS1 is extended toward the second direction DR2. From the above view, a fourth horizontal connecting segment HCU4 is disposed between the projection regions of the first area A and second area B, to connect the seventh turns 410 with the eighth turns 420 on the first metal layer. In addition, the fourth horizontal connecting segment HCU4 is connected to a fourth center tap CT4 extending toward the second direction DR2.

Figure 3:
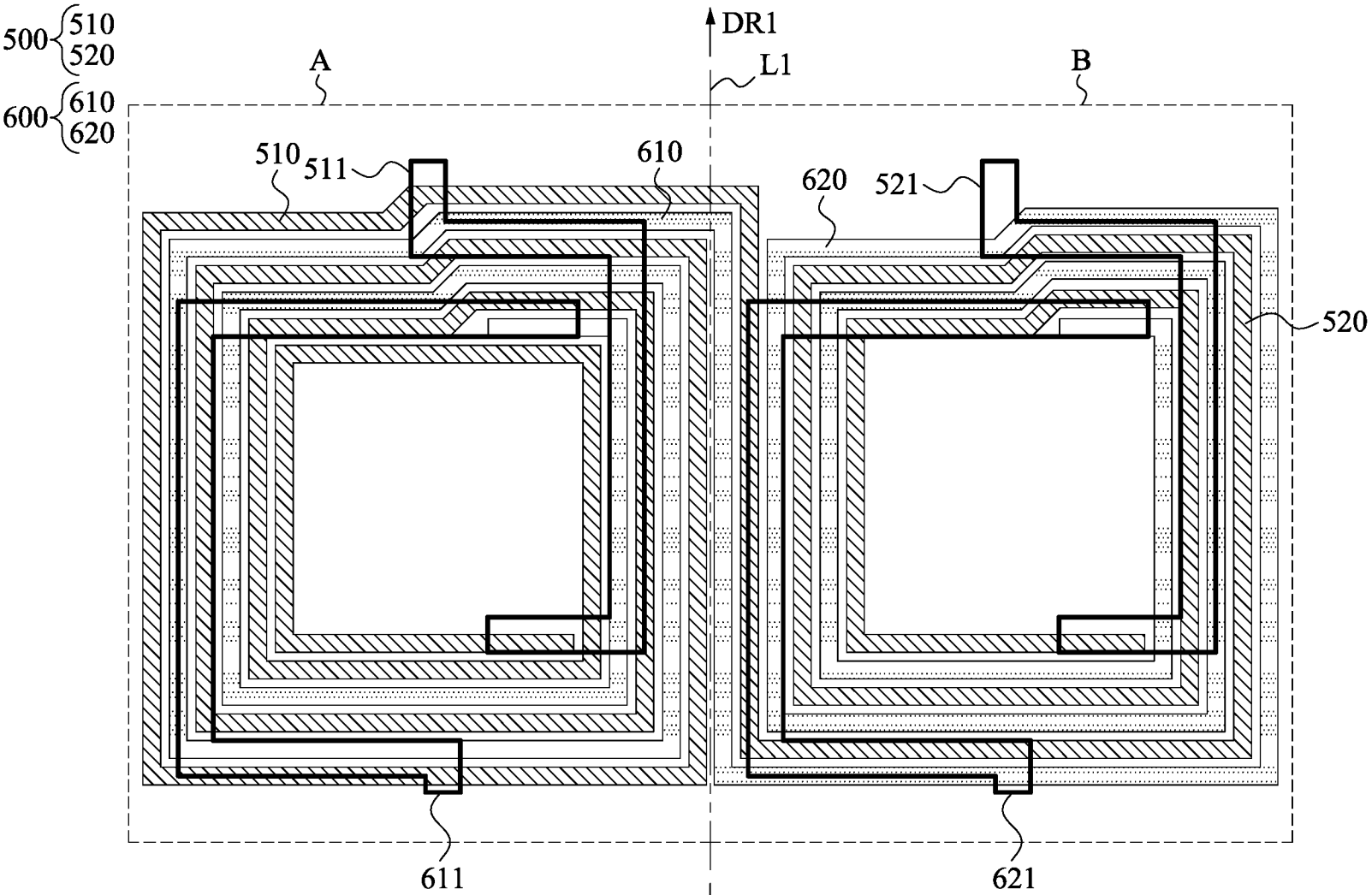
FIG. 3 is a schematic diagram of a transformer structure according to an embodiment of present disclosure.

FIG. 3 is a schematic diagram showing an above view of a transformer structure according to an embodiment of present disclosure. In the embodiment, twin planar inductors, which are a fifth inductor 500 and a sixth inductor 600, form the transformer structure. The fifth inductor 500 includes ninth turns 510 and tenth turns 520. The sixth inductor 600 includes eleventh turns 610 and twelfth turns 620. In general, the arrangements of the fifth inductor 500 and the sixth inductor 600 are similar to the first inductor 100 and the second inductor 200 as shown in FIG. 1. The fifth inductor 500 and the sixth inductor 600 are substantially disposed on the first metal layer of an integrated circuit board. However, in comparison with the embodiment of FIG. 1, the ninth turns 510 and the tenth turns 520 in the embodiment have different numbers of turns in the first area A and the second area B, respectively. The eleventh turns 610 and the twelfth turns 620 in the embodiment have different numbers of turns in the first area A and the second area B, respectively. Moreover, in the embodiment, the fifth inductor 500 includes a third extension segment 511 and a fourth extension segment 521. The third extension segment 511 and the fourth extension segment 521 are disposed on the second metal layer, within the projection regions of the first area A and the second area B. Similarly, the sixth inductor 600 includes a fifth extension segment 611 and a seventh extension segment 621. The fifth extension segment 611 and the seventh extension segment 621 are disposed on the second metal layer, within the projection regions of the first area A and the second area B.

Figure 4:
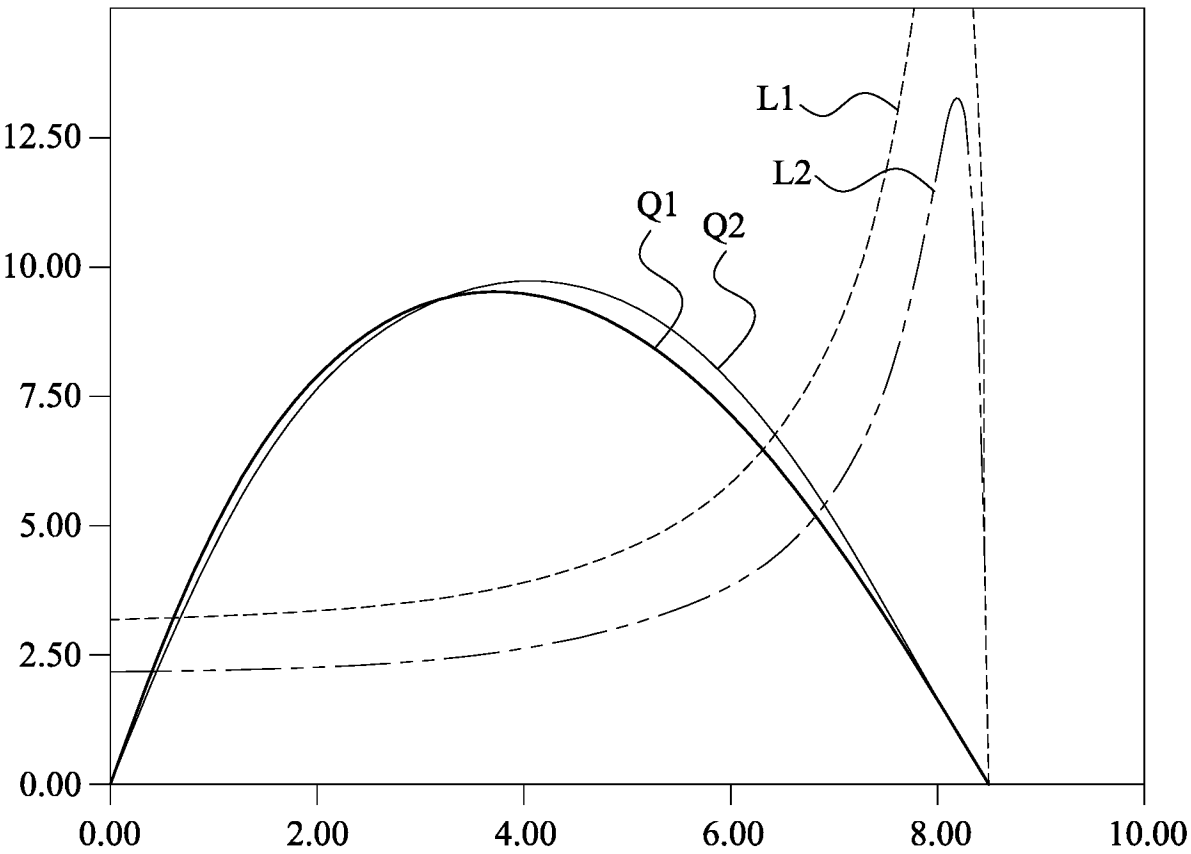
FIG. 4 is a schematic diagram showing an experiment result of the transformer structure according to the embodiment of present disclosure.

FIG. 4 is a schematic diagram showing an experiment result of the transformer structure according to the embodiment of present disclosure. As shown in FIG. 7, the horizontal axis indicates frequencies, and the vertical axis indicates values of Q factors and L factors. The curve Q1 illustrates the quality factors obtained from the first inductor 100 of the transformer structure of FIG. 1. The curve Q2 illustrates the quality factors obtained from the second inductor 200 of the transformer structure of FIG. 1. Obviously, under most of the frequencies, the fluctuations of the curve Q1 and the curve Q2 are substantially matched. It is to say, the Q factors of the twin inductors are ideal and symmetric. The curve L1 illustrates the mutual inductance obtained from the first inductor 100 of the transformer structure of FIG. 1. The curve L2 illustrates the mutual inductance obtained from the second inductor 200 of the transformer structure of FIG. 1. Under most of the frequencies, the fluctuations of the curve L1 and the curve L2 are substantially matched. It is to say, the inductances of the twin inductors are symmetrical.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A transformer structure, comprising:

a first inductor having first turns and second turns, wherein the first inductor comprises a first horizontal connecting segment, and the first horizontal connecting segment is independent from the first turns and the second turns, wherein the first horizontal connecting segment connects the first turns with the second turns, and the first horizontal connecting segment is connected to a first center tap; and a second inductor having third turns and fourth turns;

wherein the first turns of the first inductor and the third turns of the second inductor are mutually disposed in a first area of a first metal layer, and the second turns of the first inductor and the fourth turns of the second inductor are mutually disposed in a second area of the first metal layer, wherein the first area is adjacent to the second area.

2. The transformer structure of claim 1, wherein the first inductor comprises a first port and a second port, the first port and the second port are disposed on the first metal layer.

3. The transformer structure of claim 2, wherein the first port and the second port are differential ports.

4. The transformer structure of claim 2, wherein the first port is disposed in the first area and the second port is disposed in the second area.

5. The transformer structure of claim 4, wherein the first port is disposed outside a region of the first area that covered by the first turns and the third turns, and the second port is disposed outside a region of the second area that covered by the second turns and the fourth turns.

6. The transformer structure of claim 1, wherein the second inductor comprises a third port and a fourth port, the third port and the fourth port are disposed on a second metal layer.

7. The transformer structure of claim 6, wherein the third port and the fourth port are differential ports.

8. The transformer structure of claim 6, wherein the third port is disposed in a third area of the second metal layer and the fourth port is disposed in a fourth area of the second metal layer.

9. The transformer structure of claim 8, wherein the third port is disposed outside a region of the third area that the first turns and the third turns are projected onto, and the fourth port is disposed outside a region of the fourth area that the the second turns and the fourth turns are projected onto.

10. The transformer structure of claim 9, wherein the second inductor includes a first metallic segment connected to the third port and a second metallic segment connected to the third port, the first metal segment is extended crossing the region of the third area that the first turns and the third turns are projected onto, and the second metal segment is extended crossing the region of the fourth area that the the second turns and the fourth turns are projected onto.

11. The transformer structure of claim 10, wherein the second inductor includes a first vertical connecting segment and a vertical connecting segment, the first vertical connecting segment connects the third turns with the first metallic segment, and the second vertical connecting segment connects the fourth turns with the second metallic segment.

12. The transformer structure of claim 1, wherein the second inductor includes a second horizontal connecting segment, the second horizontal connecting segment connects the third turns with the fourth turns.

13. The transformer structure of claim 12, wherein the second horizontal connecting segment is connected to a second center tap.

14. The transformer structure of claim 13, wherein the first horizontal connecting segment and the first center tap are disposed on a second metal layer.

15. The transformer structure of claim 14, wherein the second horizontal connecting segment and the second center tap are disposed on a third metal layer.

16. The transformer structure of claim 15, wherein the first center tap and the second center tap are disposed in parallel.

17. The transformer structure of claim 16, wherein the first center tap is extended toward a first direction and the second center tap is extended toward a second direction, the first direction is opposite to the second direction.

18. The transformer structure of claim 16, wherein the second inductor includes a third port and a fourth port, the third port and the fourth port are disposed on the third metal layer and toward the second direction.

19. The transformer structure of claim 1, wherein the first inductor and the second inductor are twin planar inductors.

20. The transformer structure of claim 19, wherein the first turns and the second turns of the first inductor form a first eight-shaped structure, and the third turns and the fourth turns of the second inductor form a second eight-shaped structure.

* * * * *